US005643029A

United States Patent [19]

Rudofsky

[11] Patent Number: 5,643,029

[45] Date of Patent: Jul. 1, 1997

[54] MOTORIZED SURF BOOTS

[76] Inventor: Keith M. Rudofsky, 2520 Allenwood-Lakewood Rd., Howell, N.J. 07731

[21] Appl. No.: 678,606

[22] Filed: Jul. 15, 1996

[51] Int. Cl.[6] ..... B63B 35/83

[52] U.S. Cl. ..... 441/76; 441/68

[58] Field of Search ..... 441/68, 70, 65, 441/76, 77, 74, 73; D12/300, 307

[56] References Cited

U.S. PATENT DOCUMENTS

| | | | |
|---|---|---|---|
| D. 236,744 | 9/1975 | Sharpe | 441/68 |
| 2,559,977 | 7/1951 | Lundborg | 441/68 |
| 2,740,972 | 4/1956 | Taylor | 441/70 |
| 3,144,849 | 8/1964 | Maser | 441/76 |

FOREIGN PATENT DOCUMENTS

| | | | |
|---|---|---|---|
| 126955 | 7/1928 | Switzerland | 441/77 |

*Primary Examiner*—Edwin L. Swinehart
*Attorney, Agent, or Firm*—Charles I. Brodsky

[57] ABSTRACT

The apparatus of the invention offers a new sports activity, somewhere between roller-blading and waverunning, by incorporating a pair of boots on a pair of boards, and powering the combination by a pair of centrifugal clutch motors of rating not exceeding 5.0 horsepower, with a pair of throttled controls respectively coupled forwardly from the motors to extend to a position and height where they can be held and adjusted by a user in varying the horsepower delivered to the boards. In a preferred embodiment of the invention, the apparatus is intended for use in a water environment, although by adding wheels to the underside of the boards, the apparatus can be modified for land use.

16 Claims, 10 Drawing Sheets

MOTORIZED SURF BOOTS

FIELD OF THE INVENTION

This invention relates to sports activities, in general, and to a new and exciting activity which, through simple and appropriate modification, can be tailored to uses for the aged and/or infirm.

BACKGROUND OF THE INVENTION

As is well known and understood, athletics have always played a major part in one's day-to-day activities. Whether it be as a child growing up, or as an adult in maintaining fitness, sports oftentimes plays an important role during each person's waking hours. As is also well known and understood, not everyone is of the same (or even similar) athletic prowess—and, for such reason, many sports activities have been designed for individual use, rather than as a team endeavor. Figure skating, long distance running, gymnastics, and golf are, perhaps, the foremost examples of these pastimes.

In recent years, furthermore, more and more of these individualistic sports have been developed. Typical of these are skateboarding, roller-blading, wind-surfing, and waverunning. An obvious limitation of the first two is that it can only be done on a smooth surface, such as a sidewalk or street; with the latter two, it is limited to a water environment, and usually to heavy or cumbersome equipment, and to a large body of water. A reasoned analysis of these activities, furthermore, would reveal that aside from their "sporting" qualities, there exists little opportunity for their use in other, non-athletics activities.

OBJECTS OF THE INVENTION

It is an object of the present invention to provide a new and exciting sport activity for individual use, as compared to utilization in a team concept.

It is also an object of the invention to provide such an activity which, with only slight modification, can be employed on land or on water.

It is another object of the invention to provide such an activity, which, with only further modification, can be used in a non-sporting environment, to assist the aged and/or infirm.

It is a further object of the invention to provide such an athletic activity which can be adapted for use both by those who are athletically proficient, and by those of little or reduced prowess.

SUMMARY OF THE INVENTION

As will become clear from the following description, the apparatus of the present invention falls somewhere between skateboarding and roller-blading, on the one hand, and between windsurfing and waverunning (e.g. jet-skis, personal watercraft, etc.), on the other hand. In particular, the apparatus will be understood to incorporate a pair of boots, one each, on a pair of boards, powered by a pair of centrifugal clutch motors of rating not to exceed 2 horsepower. To regulate the motors, a pair of throttle controls are utilized, respectively coupled forward one from each motor, to extend to a position and height where the throttle controls can be grasped (one in each hand) by a user to vary the horsepower delivered to each board. In a preferred embodiment of the invention, intended for use in a water environment, a pair of drive-shafts and propellers are connected together, and respectively coupled to the motors to be powered thereby. In such an arrangement, each board is constructed of a Vee cross-section, narrowing from a top side thereof, to an underside thereof, so as to easily cut through the water.

In a second embodiment of the invention, one or more wheels or rollers can be coupled to the underside of the board, for use on sidewalks or streets, and generally on pavement or dirt. Alternatively, and as will be appreciated by those skilled in the art—through regulation of the horsepower deliverable, the apparatus can be fabricated for use by the aged or infirm, instead of employing a wheelchair to get about, or as an aid in walking, where that represents a medical problem.

As will also become apparent from the description that follows, a centrifugal clutch motor is employed, along with the throttle control, so as to ensure that the motor will idle, and the boards not run away, should the user stumble or fall from the board, thereby providing the apparatus with what has been described as a "dead-man's clutch".

As different user's of the apparatus are of different physical stature and size, and as their skill propensities may vary, the apparatus of the invention will also be seen to allow the boots (or foot supports) to be moved forwardly or rearwardly, away from or towards the motor in setting up the apparatus for use. Provided with both front and rear bindings for securement when worn, the boots may additionally be offset to an edge surface of the board to further ensure their being easily retrieved should a user stumble from them, as the "weighting" of the board will be in a direction to cause it to "circle" if left unattended with the motor still running.

As will be appreciated, it may very well take some practice before the motorized surf boots of the invention may be skillfully used, either on land or water. To assist in attaining that degree of skill required to do this proficiently, the apparatus of the invention will also be seen to include second pairs of boards, coupled to the first pair in a similar manner to that in which "training wheels" are employed in assisting a youngster to ride a two-wheel bicycle. With the present invention, this second pair of boards will be seen to couple to the first pair of boards forwardly of the foot supports, and to be readily detachable once the talent level of the user has increased.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
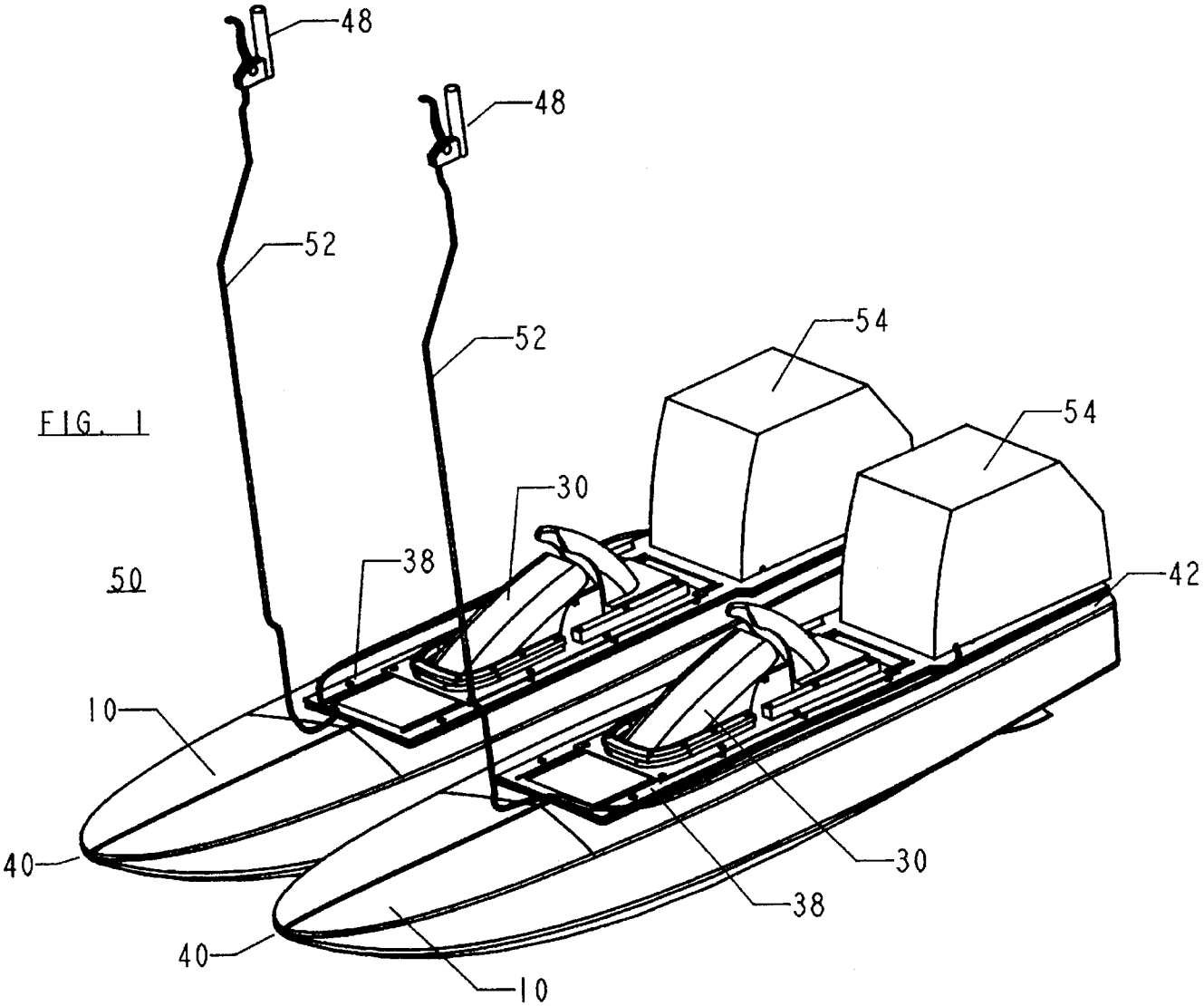
FIG. 1 is a front perspective view of a preferred embodiment of motorized surf boot apparatus constructed in accordance with the invention, and for use in the water.
Figure 2C:
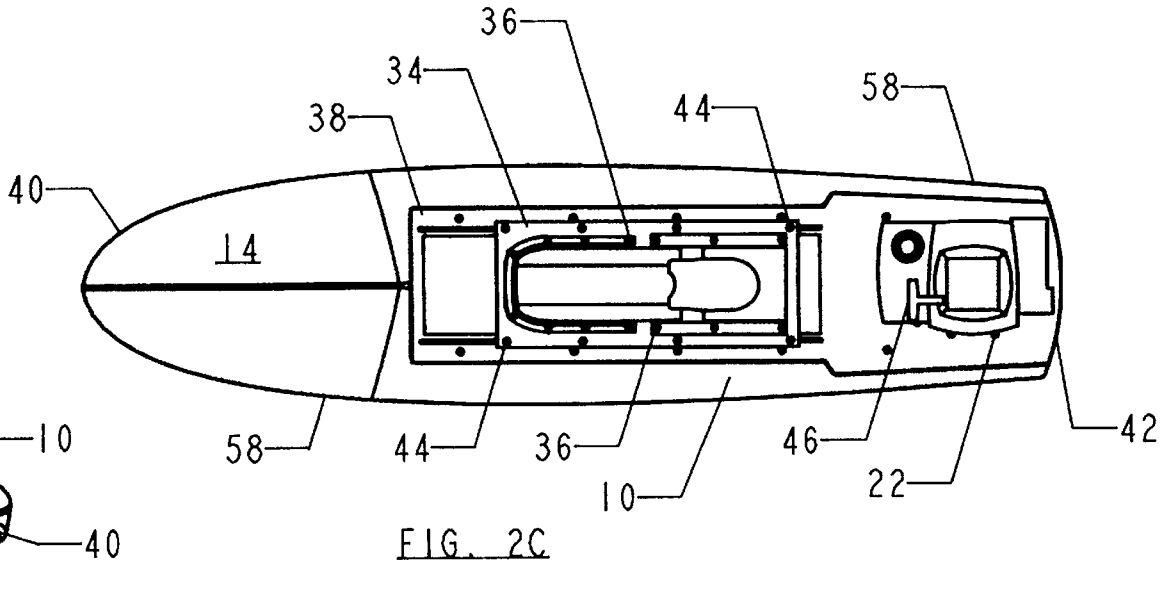
FIGS. 2A, 2B, 2C and 2D are front perspective, front, top and left side views of one of the boards of the invention, without the throttle control being connected, but with the foot supporting boot in position.
Figure 2D:
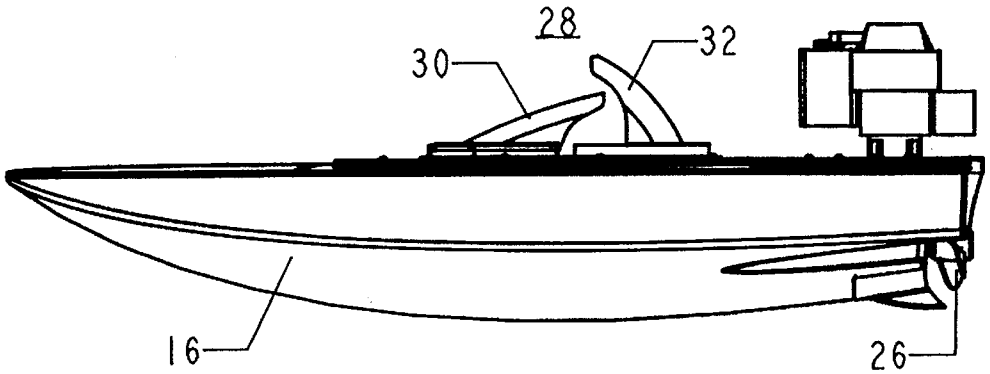
Figure 2A:
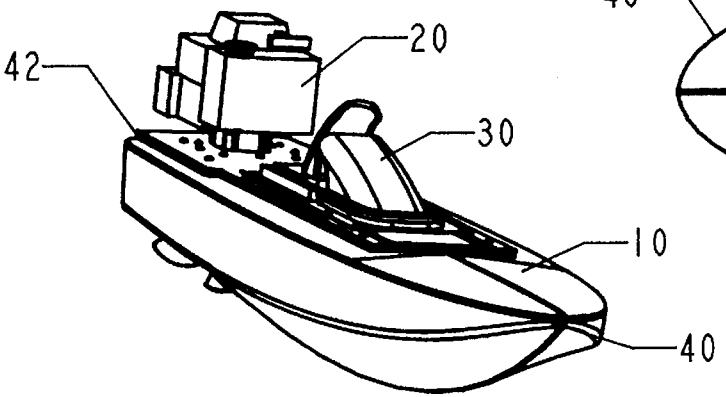
Figure 2B:
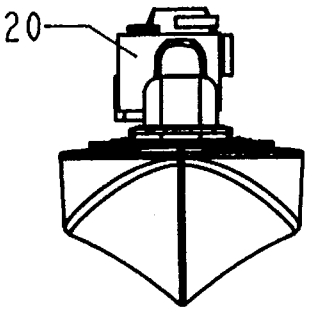
Figure 3C:
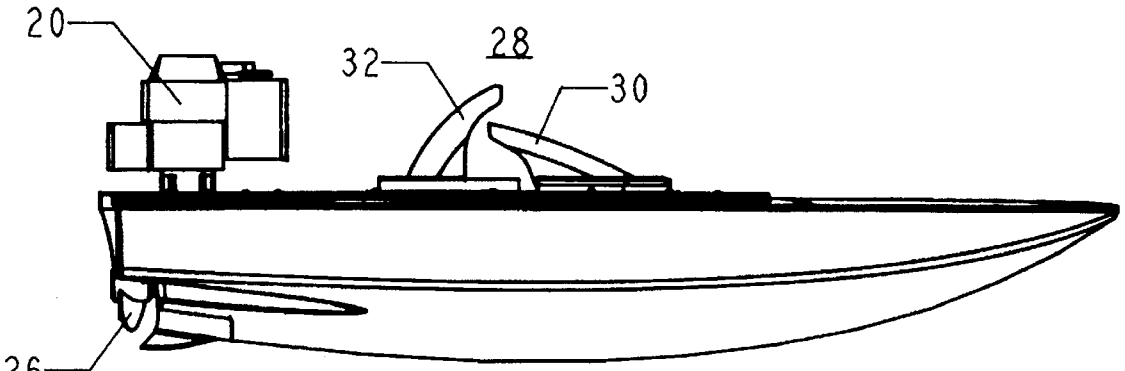
FIGS. 3A, 3B, 3C and 3D are rear perspective, rear, right side and bottom views of a board of the invention intended for use in a water environment, again with the throttle control omitted but with the foot supporting boot in position.
Figure 3D:
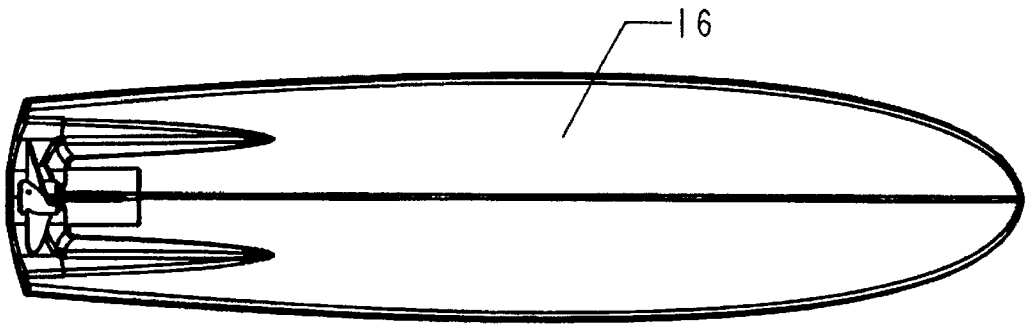
Figure 3B:
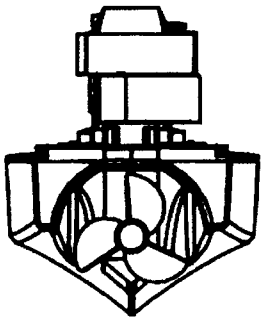
Figure 3A:
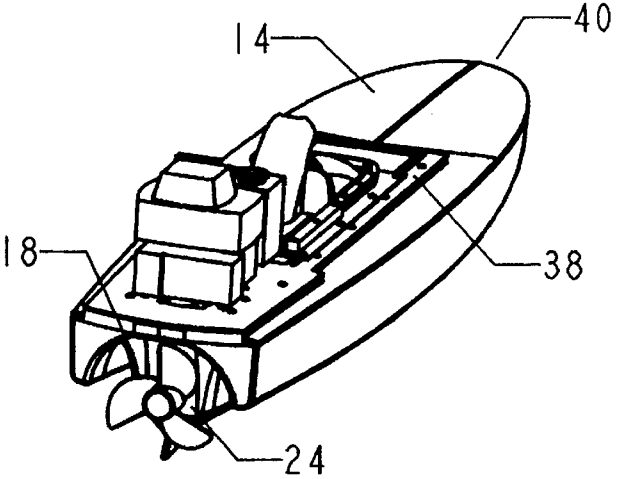
Figure 4B:
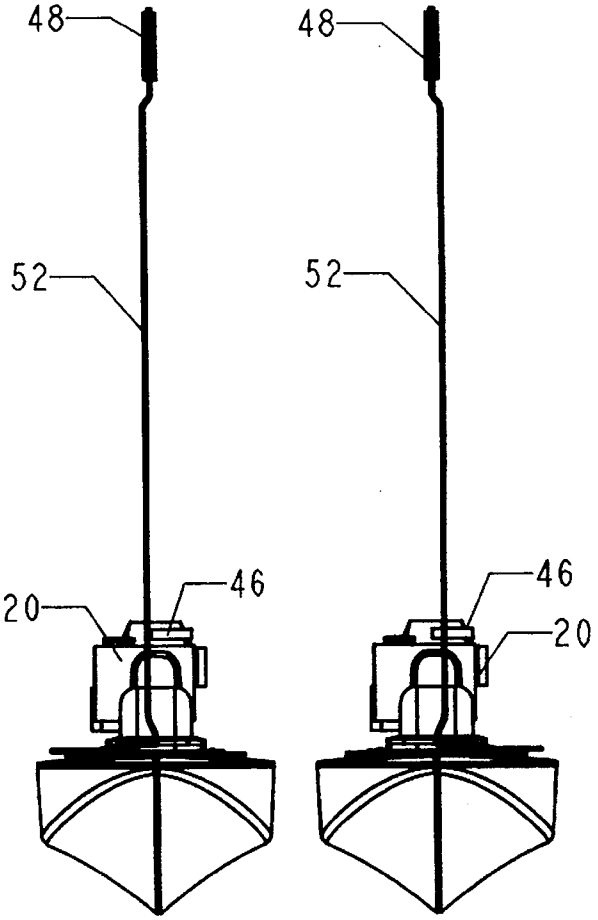
FIGS. 4A and 4B show rear perspective and front views of a pair of boards arranged in accordance with the invention, but with the throttle controls in position.
Figure 4A:
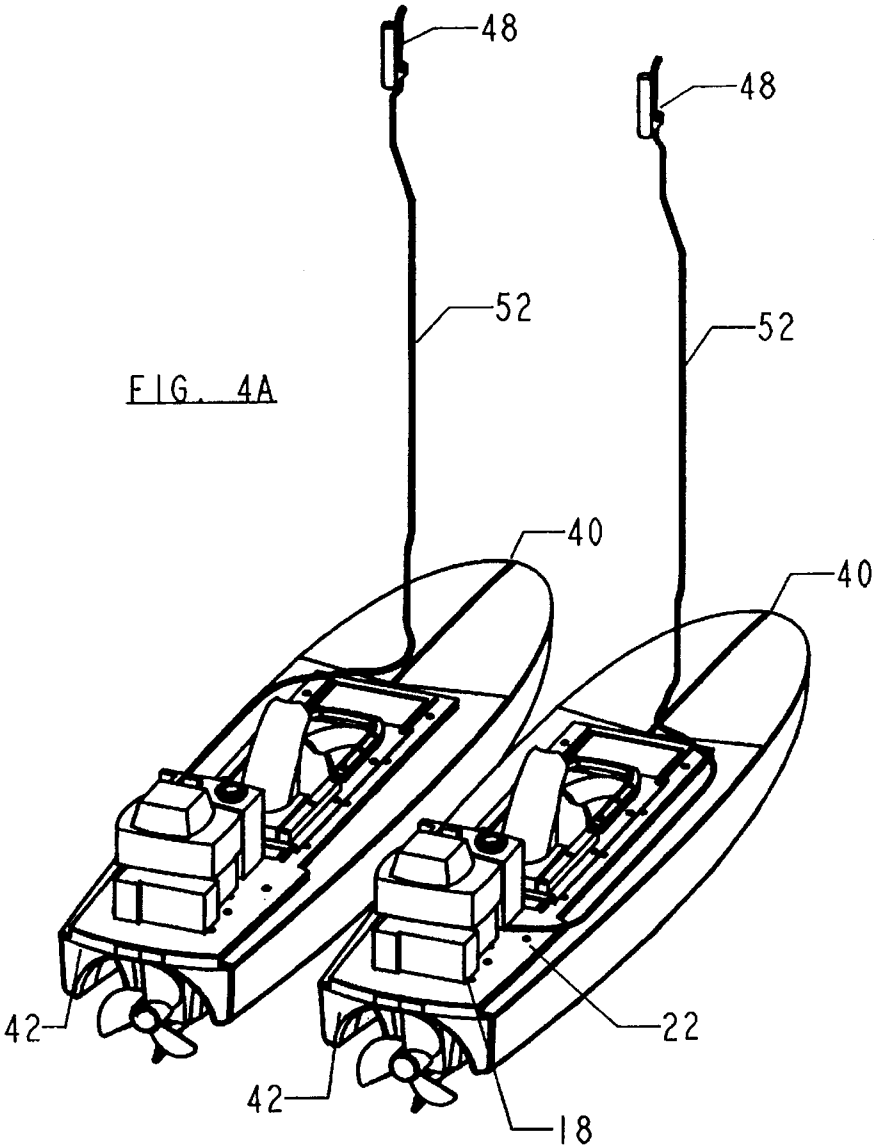
Figure 5:
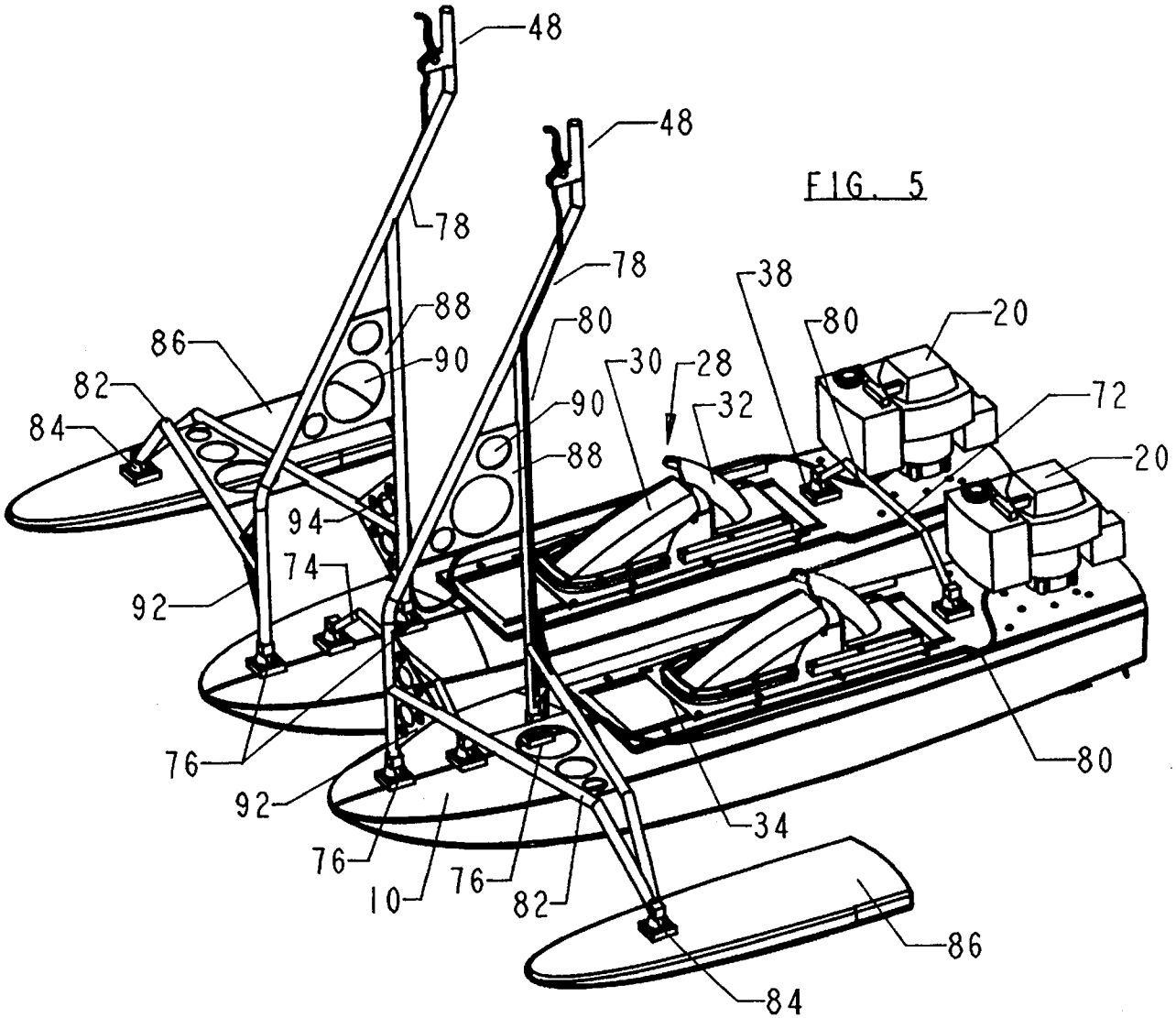
FIG. 5 is a front perspective view of a second embodiment of the invention for use in a water environment, as including the training feature of the invention in assisting a user in gaining proficiency with the apparatus.
Figure 6:
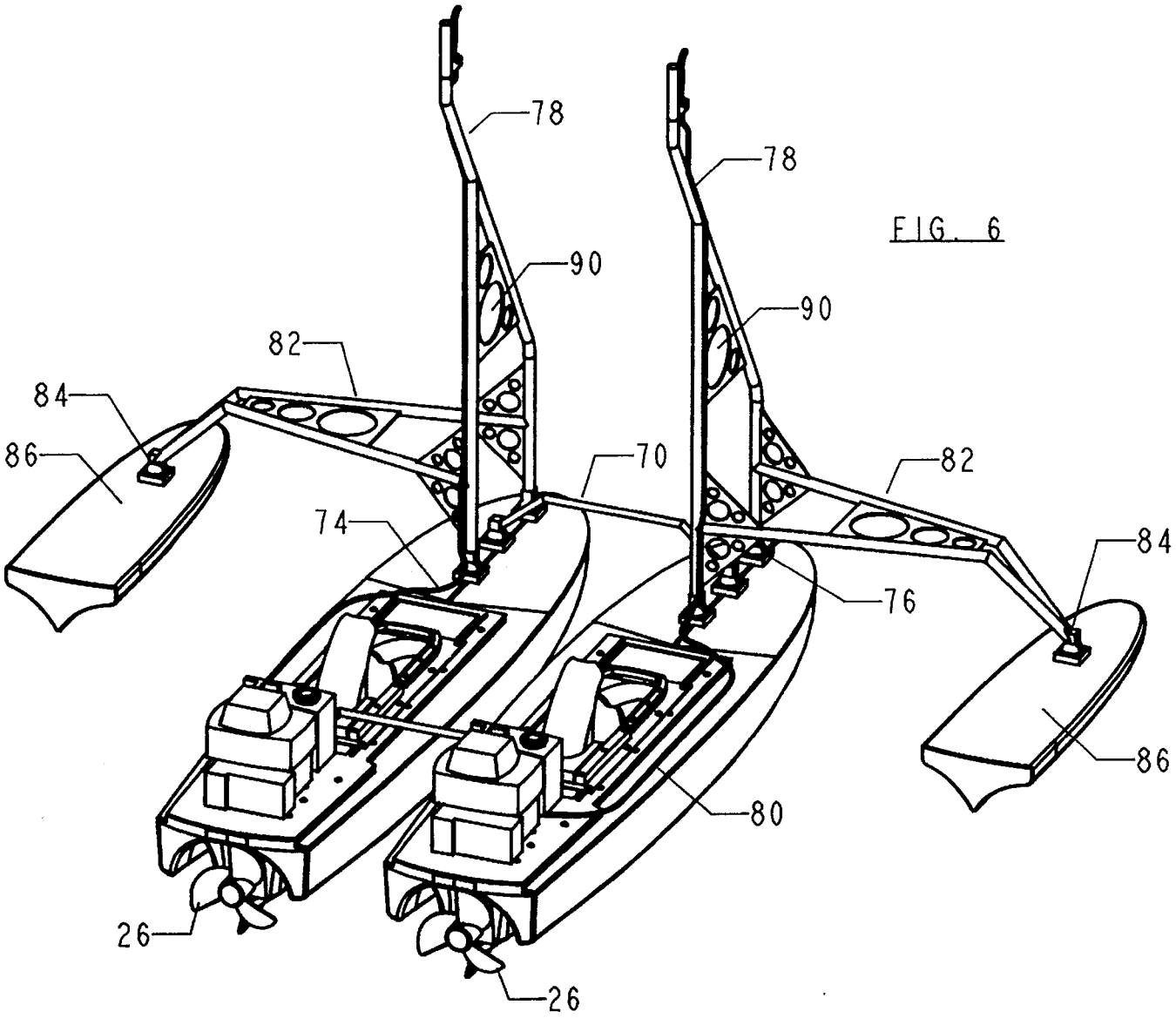
FIG. 6 is a rear perspective view of the embodiment of FIG. 5.
Figure 7:
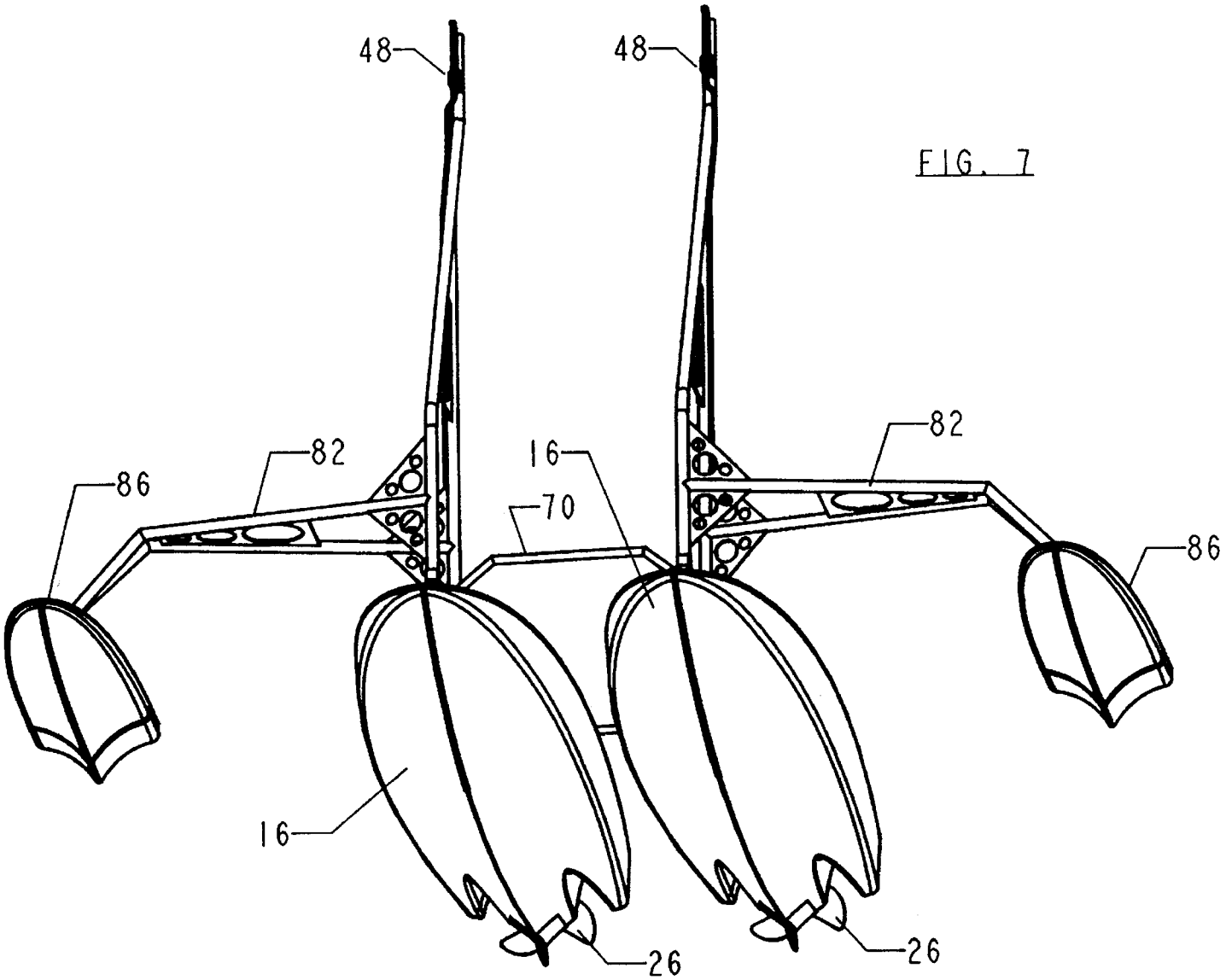
FIG. 7 is a bottom perspective view of the apparatus embodied in FIG. 5.
Figure 8:
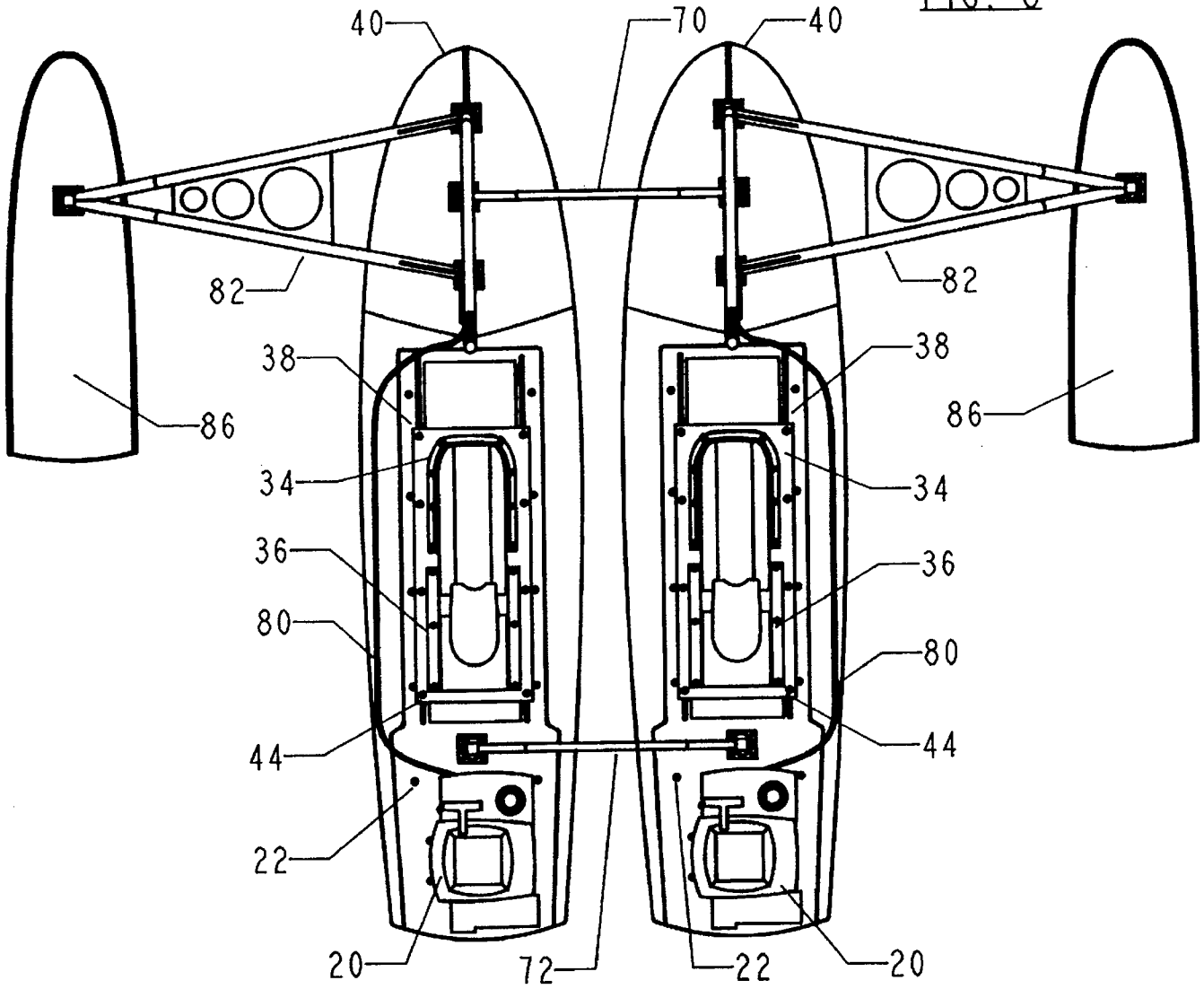
FIG. 8 is a top view of the embodiment of FIG. 5.
Figure 9:
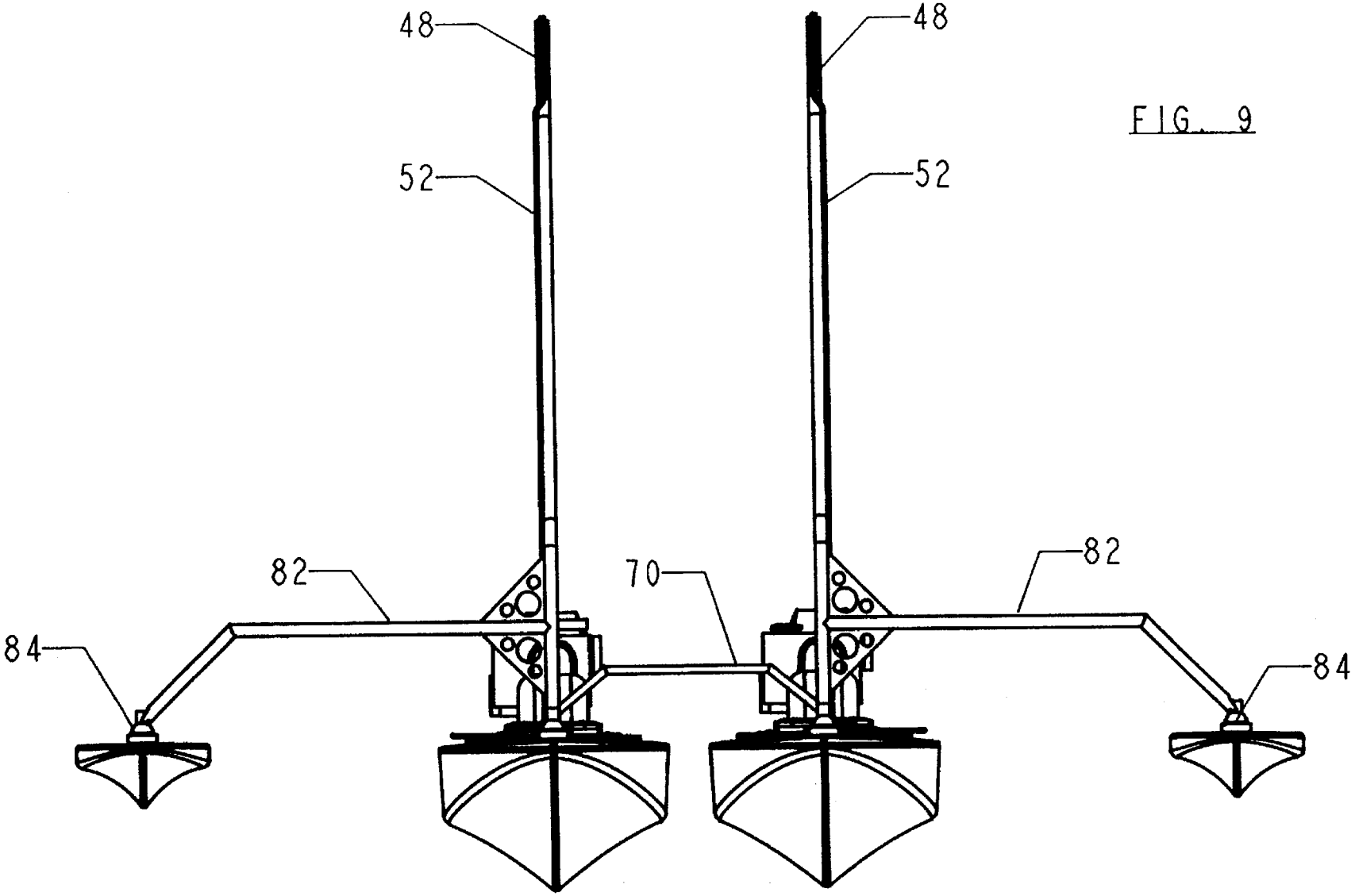
FIGS. 9 and 10 are front and side views of the embodiment of FIG. 5, respectively.
Figure 10:
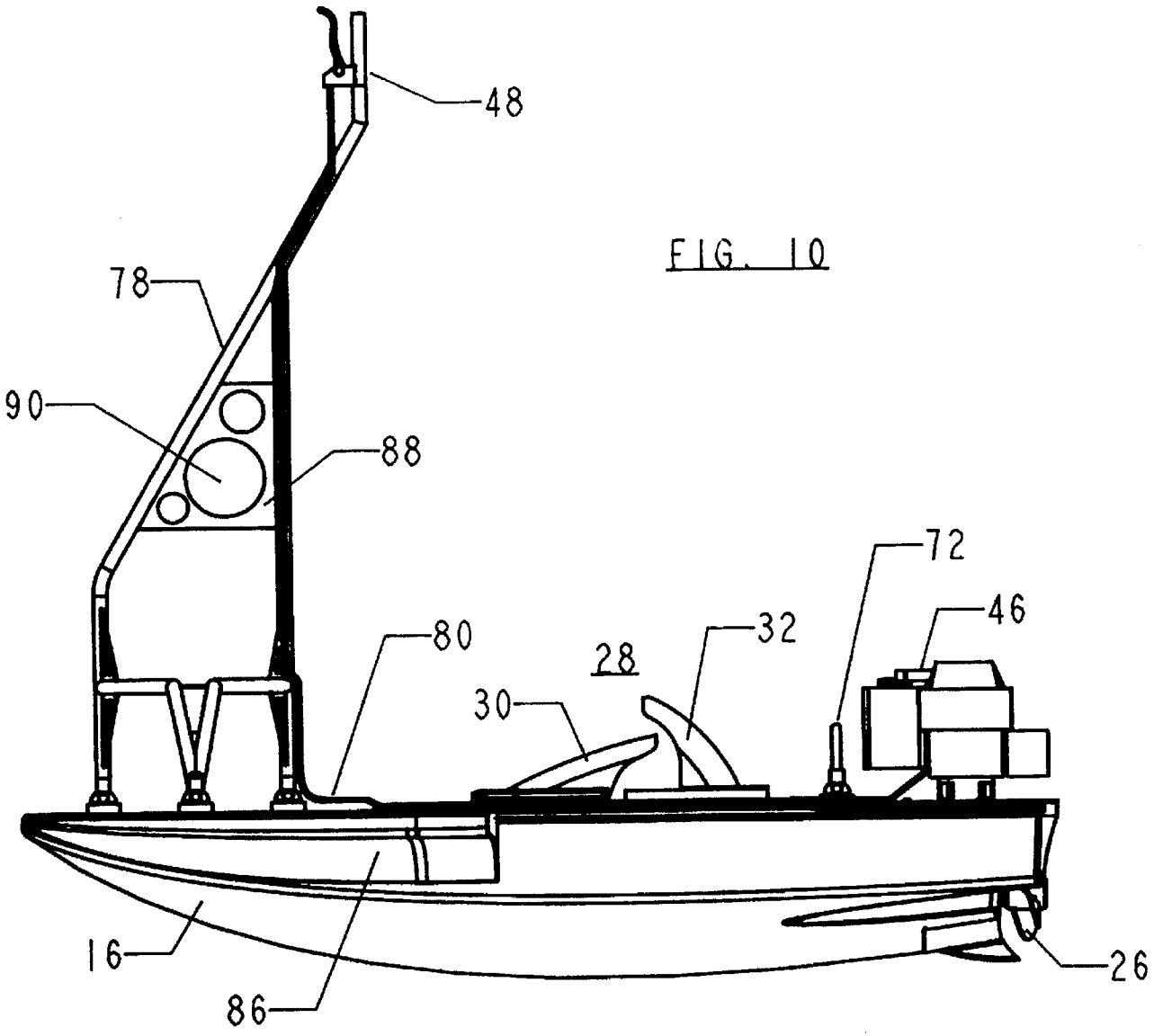

In the embodiments of the invention shows in FIGS. 1–10, and their sub-parts, for use in a "water" environment, as on a lake, bay, river or ocean, the pair of boards employed are illustrated by the reference numeral 10, as being of predetermined length and width in accordance to the size and weight of a user, and preferably of an injection-molded plastic composition or other appropriate material. When used in this "water" environment, the boards 10 are arranged of a Vee cross-section 12 to act as an efficient hull, narrowing from a top side 14 to an underside 16. Secured to each of the boards 10, by any appropriate mounting means 18 are a pair of motors 20, each having a centrifugal clutch and of a rating not exceeding 5 or 10 horsepower—and preferably of a rating of 1.0–2.0 horsepower so as to make the overall apparatus controllable by most users of average competency. A series of screws 22 are shown in securing the mounts 18 to the top side 14 at the rear of the boards 10. As illustrated, the front end 40 of each board is tapered, as an aid in cutting through the water during forward motion. In accomplishing this, each of the motors 20 is coupled with a drive-shaft 24 and a propeller 26 of appropriate size and configuration to safely and adequately move the boards 10 and the user standing thereon in the water environment in question—whether it be tranquil as a lake, or uneven as a bay.

To such end, a pair of boots 28 are shown, one for each inserted foot, and each having a front binding 30 and rear binding 32 of any appropriate configuration, fabrication, and strength. A first horizontal plate 34 is provided, along with a series of screw holes 36, to permit the boots 28 to be adjusted in length, simply by moving the front and rear bindings 30, 32 toward or away from one another, and then by fastening screws or other fastener devices to fit the user's foot.

Such horizontal plate 34 is itself adjustable in position on a second horizontal plate 38 secured to the top side 14 of each board 10 in moving the plate 34 (and the boot 28 secured thereto) forwardly towards the tapered end 40 of the board 10, or rearwardly towards its motor mounted end 42 depending upon the degree of control and stability desired by the user of the apparatus 50, and depending upon how "fancy" the user might want to be in just going forward, turning, and orienting the tapered end 40, as by to circumvent a slalom-type course, for example. As illustrated, the horizontal plate 34 also has a plurality of screw-holes 44, to tie-down the plate 34 once the position has been decided upon by the user. In such manner, each boot 28 is thus made adjustable in foot size, and becomes adjustable in position forwardly and rearwardly on the top side 14 of the board 10.

To start the motors 20, a pair of pull handles 46 are shown, similar to the type employed in starting conventional lawn mowers. To regulate the power deliverable from each motor 20, a pair of hand-held throttle controls 48 are utilized, respectively coupled one to each motor 20 by the cable interconnect 52, with the design being such that with the throttle controls completely released (as shown in FIG. 1), the motor 20 cuts-off, and as a greater amount of pressure is provided to close the throttle 48, power is increased. In accordance with the invention, the throttle control 48 and the cable 52 are selected so that they extend forwardly from the motors 20 a distance to extend at least to the foot support boots 28 and to a height to be easily grasped by the user. As will be appreciated by those skilled in the art, once the motor is started with the pull-handle 46 (or an electric start), the power delivered to propel each board 10 forward is then controllable by the degree of pressure applied by the user to the throttle control 48. To protect the motor when using such apparatus 50 in this "water" environment, a housing 54 is employed, enclosing each of the motors 20.

(Just as learning a bicycle, or learning to skateboard or to roller-blade, it will take some practice to become familiar with maintaining stability on the board during play and to become proficient in motorizing about—either just for speed, or for turning. Obviously, such "learning experiences" would often entail the user's falling from off the board—and to such end the "dead-man's clutch" of the described throttle control serves to "kill" the motor to prevent the board's sailing away unattended, continuing to float due to the board's construction. As will be seen, the user guides and controls the direction of movement of the apparatus, either by shifting his, or her, weight back and forth or side-to-side on the board, and/or by applying different grasping pressures to the throttle controls 48 so as to provide greater thrust from one motor 20, as compared to the other.)

Thus, to further assist in learning to become proficient with the motorized surf boot apparatus 50 of FIGS. 1–4, the arrangements of FIGS. 5–10 can be utilized—first of all, to maintain the boards 10 from separating, as might happen to a novice when applying greater throttle control to one motor than to the other. Illustrated by the reference numerals 70 and 72 to prevent this, are a pair of rigid links, positioned at the tapered end 40 of the board 10, and somewhat forwardly of the motor mounted end 42, respectively. Shown with a pivotable connection typical ball and socket arrangement at 74, the two links 70 and 72 hold the boards at a fixed position relative to each other but allow each board to pivot about the connections at 74. In accordance with the invention, the links 70, 72 are detachable from the boards 20 in any appropriate manner, as shown by the pivot-coupling 74.

FIGS. 5–10 additionally show four other pivot-couplings 76 as part of a frame network 78, of which the throttle controls 48 form a part, with the cable 52 then running down the frame network 78, along the top side 14 of each board 10, as at 80, in coupling to the motors 20. As illustrated, the frame network 78 is positioned forwardly of the boots 28 on each board 10, and are of a height to place the throttle controls 48 in easy grasp of a user's hands. Coupled at the lower end of each frame network 78 is a further linkage 82, outwardly extending from the frame to connect to a third set of pivot-couplings, positioned on one of a second pair of boards 86, of predetermined length, width and cross-section, substantially parallel to the boards 10, and at any prescribed distance therefrom. When constructed of a Vee cross-section, the boards 86 serve the same type of function as "training wheels" do for a bicycle, in steadying the boards 10 as a pair of pontoons, to the user stepping into the boots 28. Thus, the boards 86 serve to provide support and stability as the user begins to learn how to steady himself or herself on the boards 10, while varying the setting of the throttle controls 48 by adjustable pressure on them and by foot pressure or leaning to pivot the boards so as to steer. Although the boards are at a fixed distance to each other, they can be pivoted for turning thus allowing a novice to practice basic steering control, without boards running away from each other. Additionally shown are a pair of side panels 88 on the frame network 78 in supporting the structure, and which is apertured, as at 90, to lessen weight, and allow air currents to pass therethrough. In similar manner, a pair of front panels 92 provide stability and support to the linkages 82 extending to the boards 86, with those front panels 92 similarly being aperture, as at 94, to lessen weight, and allow the air to move through the panels 92 as the apparatus 50 propels forward. As with "training wheels", the frame network 78, the second pair of boards 86, the rigid links 70, 72, and the pivotable couplings 74, 76 and 84 are all detachable, for removal from the boards 10, once the user has become comfortable with the performance of the apparatus, and is ready to try to use it on his, or her, own. In such manner, the pivotable-couplings 74, 76 and 84 might be securable to the boards 10 and 86 by any appropriate manner.

As previously mentioned, with the boards 10 (and 86 where used) constructed of an injection molded plastic, or any other appropriate material, it becomes an easy matter to tailor the length, width and cross-section of the board to the user's size and capabilities. Utilizing, furthermore, centrifugal clutch motors of a 0.25–5.0 horsepower rating, the apparatus 50 then would have an overall weight (even with the motors 20 secured) of not more than 50 pounds, so that the apparatus 50 can be carried about, placed in a trunk or back seat of a motor vehicle simply and easily, without any need for trailering it about.

In an alternative construction, apparent to those skilled in the art, the boards 10 can be of a flattened cross-section, and to carry wheels or rollers on its underside for use on sidewalks, streets, pavement or dirt. In such manner, once started, the apparatus 50 can be used as an "on land" racing vehicle, with analysis showing that users could accommodate motors of up to 5.0 horsepower rating, safely and without falling. With such modification, a pair of motorized "skateboards" could result, leading to additional competitions in race environments.

As will also be seen, the constructions of FIGS. 5–10 could likewise be modified to utilize rollers and wheels at the bottom of the boards 10 and 86, and adjusting downward the horsepower ratings of the motors 20 used, to allow the aged and infirm to get about in those instances where they have difficulty walking. Then, once the motor is started, the user would continue to adjust the throttle pressure, in moving the overall apparatus forwardly. Analysis has shown that with a pair of 1.6 horsepower motors, and without the frame network 78 of FIGS. 5–10 employed, land speeds of some 25–35 mph could be reached depending upon the characteristics of the terrain being traversed.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. Apparatus comprising:

a pair of boards of predetermined length, width and cross-section, with each comprising a single floatation chamber defined by top, bottom and side surfaces;

a pair of motors, each having a centrifugal clutch and of a rating not exceeding 5.0 horsepower;

first means respectively securing each of said motors at a rear end of each of said pair of boards, and on said top surface thereof;

a pair of foot supports, each including front and rear bindings;

second means respectively positioning each of said foot supports on said top surface of each of said pair of boards, positioned between said motor secured at said top surface and a front end of said second board;

and a pair of throttle controls respectively coupled forwardly from each of said pair of motors a distance to extend at least to said foot support and to a height to be held in the hand of a user of said apparatus;

with said throttle controls being adjustable to vary the horsepower delivered to said boards at any given instant of time.

2. The apparatus of claim 1 wherein there are also included a pair of driveshafts and propellers connected thereto, respectively coupled to said pair of motors to be powered thereby.

3. The apparatus of claim 2 wherein said pair of boards are each of a Vee cross-section, narrowing from said top surface thereof, to said bottom surface thereof.

4. The apparatus of claim 3 wherein said first means respectively secures said motors to said boards midway between edge surfaces thereof.

5. The apparatus of claim 4 wherein said pair of boards are each of an injected-molded plastic composition.

6. The apparatus of claim 1 wherein said second means is adjustable forwardly and rearwardly for varying the specific location in positioning said foot supports between said motor and said front end of said board.

7. The apparatus of claim 4 wherein there are also included a pair of housings of plastic composition, respectively enclosing each of said drive-shafts.

8. The apparatus of claim 3 wherein each of said motors are of a rating of 0.5–5.0 horsepower.

9. The apparatus of claim 3 wherein there are also included third and fourth means connecting said pair of boards together at points forwardly and rearwardly of said pair of foot supports, respectively.

10. The apparatus of claim 9 wherein said third and fourth means are detachable, for connecting to, and disconnecting from, said pair of boards as desired.

11. The apparatus of claim 3 wherein there is also included a second pair of boards of predetermined length, width and cross-section, coupled to said first pair of boards, in extending substantially parallel therewith and at prescribed distances therefrom.

12. The apparatus of claim 11 wherein said second pair of boards is coupled to said first pair of boards forwardly of said pair of foot supports.

13. The apparatus of claim 11 wherein said second pair of boards are detachable, for connecting to, and disconnecting from, said first pair of boards as desired.

14. The apparatus of claim 3 wherein a front end of said top surface of each of said boards joins with a front end of said bottom surface of each of said boards by a concave downwards taper, and wherein a rear end of said bottom surface of each of said boards joins with a rear end of said top surface of each of said boards by a concave upwards taper.

15. The apparatus of claim 14 wherein said side surface of each of said boards joins with said bottom surface of each of said boards along lines outwardly of said bottom surface, and wherein said bottom surface extends away from said lines in an inwardly and downwardly curvilinear arc.

16. The apparatus of claim 15 wherein said propellers are mounted to each of said boards at a point between said top surface of each of said boards and said line between said side surface and said bottom surface of each of said boards.

* * * * *